United States Patent [19]

Beretta

[11] 4,437,250

[45] Mar. 20, 1984

[54] REVOLVER

[75] Inventor: Pier C. Beretta, Brescia, Italy

[73] Assignee: Fabbrica d'Armi P Beretta S.p.A., Italy

[21] Appl. No.: 283,819

[22] Filed: Jul. 16, 1981

[30] Foreign Application Priority Data

Jul. 18, 1980 [IT] Italy ..... 5187 A/80

[51] Int. Cl.[3] ..... F41C 1/00

[52] U.S. Cl. ..... 42/59; 42/65

[58] Field of Search ..... 42/59, 62, 65, 68

[56] References Cited

U.S. PATENT DOCUMENTS

| | | | |
|---|---|---|---|
| 1,004,172 | 9/1911 | Johnson | 42/65 |
| 1,491,635 | 4/1924 | Russ | 42/59 |
| 3,810,326 | 5/1974 | Hillberg et al. | 42/59 |
| 4,213,263 | 7/1980 | Brouthers | 42/65 |

*Primary Examiner*—Charles T. Jordan

*Attorney, Agent, or Firm*—McGlew and Tuttle

[57] ABSTRACT

A revolver of the type which has an opening for the lateral displacement of the drum to be loaded, which revolver is characterized in that the handle and the step thereof are secured to each other by a mortise-like coupling which simplifies the separation of the two members. The weapon has a more practical positioning of the component parts of the firing mechanism so as to facilitate the access and maintenance of the mechanism.

13 Claims, 5 Drawing Figures

REVOLVER

FIELD OF THE INVENTION

The present invention is directed generally to an improved revolver of the type having an opening for the lateral displacement of a revolving drum and having a body comprising two members separable from each other and more particularly to an improved revolver having a handle carrying at least some components parts of the firing mechanism and a stem carrying the barrel, the firing pin and the revolving drum.

BACKGROUND OF THE INVENTION

Revolvers of the rotating drum type are generally known. However, the known firearms of this type suffer from drawbacks with respect to the ease of assembly and separation of the two members comprising the body of the weapon which are held together by means of screws, and with respect to the rapidity of mounting and dismounting of the drum unit, and with respect also to the comfort in access to and maintenance of the component parts of the firing mechanism.

BRIEF SUMMARY OF THE INVENTION

It is therefore an object of the present invention to provide an improved revolver of the type mentioned above, in which the assembly of the handle and of the body is obtained without employing blocking screws, but simply by mortising these two component parts, utilizing a single transverse spine which may be extracted during the operation of separation of the two component groups.

It is another object of the present invention to provide a revolver with a more practical positioning of the component parts for the firing mechanism, so that the firing mechanism is completely contained within the handle of the weapon in order to be fully exposed and accessible for maintenance purposes when the handle is separated from the body of the weapon.

It is a further object of the present invention to provide a revolver with means for rapid mounting and dismounting of the rotatable drum, as well as with means for the recovery of the coupling place between the handle and the body, and with means for a more correct action of the trigger, so as to render the utilization of the weapon more comfortable and safer.

BRIEF SUMMARY OF THE DRAWINGS

These and other objects of the invention will become clear from the following detailed description of the invention and from the accompanying drawings, which are an exemplary illustration of a practical realization of the weapon of the invention, in which.

DETAILED DESCRIPTION OF THE INVENTION

Figure 3:
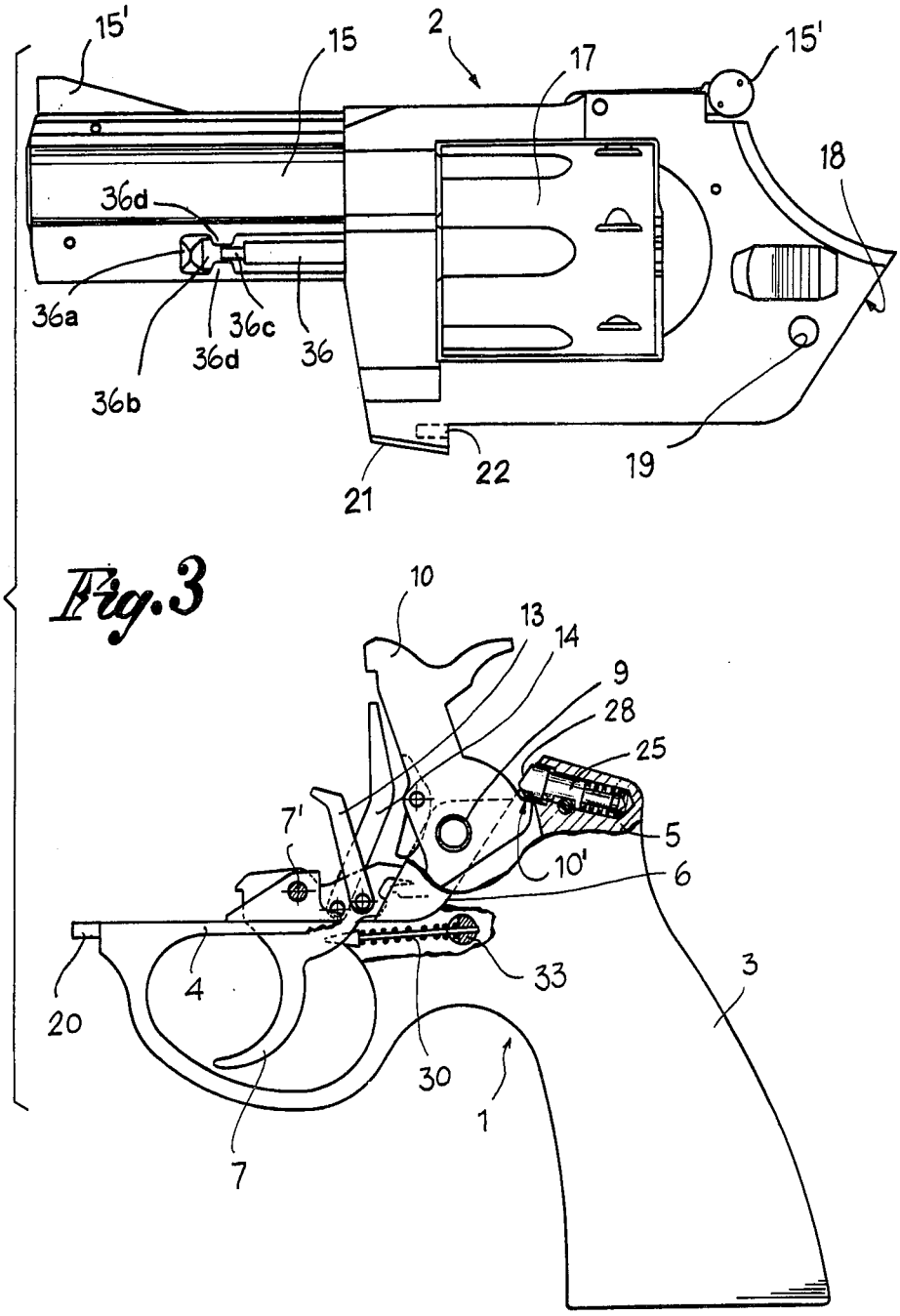
FIG. 3 is an exploded side elevational, partially in section, view illustrating the two component units of the revolver, separated from each other.

With reference to the accompanying drawings, the revolver of the present invention comprises a body having two members indicated generally with reference characters 1 and 2 respectively. The member 1 comprises a handle 3 and an underguard 4, the handle being provided with an upper portion 5 which extends above the plane of the underguard 4 and has an inclined strike surface 6 on the side facing the underguard 4. The trigger 7 is pivotably attached to the underguard 4 and 7' while on the inclined surface 6 of the upper portion 5 of the handle 3 there are two small ears 8, one on each side, defining a U-shaped seat, between which ears 8 there is pivotably attached, by means of a pin 9, a hammer 10 that is actuated by a spring (not shown). The trigger 7 is provided with a rear nose 11 which cooperates with a latch positioned on the hammer 10 for arming the hammer 10 during the employment of the weapon in double action. To the trigger 7 are also connected a rod 13 for actuating, in a manner well known, the ratcheting rotation of the drum of the weapon, and a rod-like intercepter 14 which serves to cooperate, also in a manner known per se, with the hammer 10. On the component member 1 of the weapon there is mounted, except for the firing pin, the entire firing mechanism, which as represented in FIG. 3 of the accompanying drawings is completely exposed and accessible when the members 1 and 2 which comprise the body of the weapon are separated from each other.

Member 2 in turn, comprises the body of the weapon, and carries the barrel 15, the sighting means 15', the firing pin 16 and the rotatable drum 17 which is of the type having an opening for lateral displacement and with relative blocking and unblocking means.

The member 2 or the body of the weapon, is provided in its rear portion with an inclined plane end 18 which serves to mate with the inclined surface 6 of the upper portion 5 of the handle 3. Adjacent the inclined end surface 18, there is provided in the body a transverse opening 19 which coincides with the opening defined by the pin 9 of the hammer 10.

For the assembly and mounting of members 1 and 2 to each other there is provided in the forward extremity of the underguard 4 a tongue 20, while at the base of member 2 in a shoulder 21 which serves to rest against the underguard 4 there is provided a seat 22 which corresponds to the tongue 20. Thus, in order to assembly the members 1 and 2 to each other, it is sufficient to engage in dovetail fashion, through a simple sliding movement, the tongue 20 into the seat 22 until the inclined surfaces 6 and 18 mate one against the other. To this movement corresponds the coaxial positioning of the transverse opening 19 of the body of the weapon with the opening of the sleeve pin 9 of the hammer 10, so that all that remains is to insert a blocking spine 23 within the aligned openings in order to obtain the mounting of the member 1 to the member 2 of the weapon.

The mounting of the weapon is thus simplified and rendered rapid, in that it involves only the utilization of a single transverse spine 23. Equally simple and rapid is the dismounting of the weapon's components in that all that is needed is to remove the spine 23 and to detach, in a longitudinal direction from each other, the two component parts 1 and 2 of the weapon, so as to obtain the separation thereof and the easy access, for example, to the firing mechanism.

It is to be observed that, advantageously, the spine 23, in order to facilitate its introduction and removal, is precision mounted, without forcing, within the transverse opening 19 of the body 2 and of the pin 9 and it is here arrested by friction, as explained in greater detail hereinafter.

In fact, according to another characteristic feature of the invention, in the upper portion 5 of the handle 3 there is provided a seat 24, within which there is movably positioned a pushing member 25 which faces toward the inclined surface 6 of the upper portion 5 and serves to protrude from the seat 24, and therefore toward the rear inclined plane 18 of the body 2 of the weapon, when the body is mounted.

The pusher 25 is, for example, a small piston capable of axial displacement that is limited by an arresting pin 26, so as to always be displaced toward the outside of the respective seat 24. The pusher 25 is further provided with a head surface 28 inclined in correspondence to the inclination of the strike surface 6 of the upper portion 5. The direction of push or of displacement of the pushing element 25 is thus not perpendicular to the surfaces hereinabove mentioned, but forms therewith an angle other than a right angle and this explains why it is in a plane which is not coincident with, but eccentric to the pivoting axis of the hammer 10 or to the arresting spine 23.

The pusher 25 effects various functions. In fact, the pusher 25 serves to act against the rear inclined plane 18 of the body 2 of the weapon both during the operation of assembling the members 1 and 2 and after their assembly. Such an action of the pusher 25 serves to cushion the contact between the mating surfaces 6 and 18 of the body 2 and of the upper portion of the handle 3, during the act of coupling of the members 1 and 2 and to each other and during the functioning of the weapon. Furthermore, the action of the pusher 25 on the body 2 of the weapon results in a spacing of the two members 1 and 2 in a longitudinal direction, so that a forced contact is established, by means of friction, between the surface of the transverse opening 19 of the body 2 and the surface of the arresting spine 23, the forced contact occurring only along a generatrix, or in any event, along an angular extension defined by said surfaces. Such a contact is sufficient to axially arrest the spine 23, thus preventing accidental removal thereof even if the spine 23 has not been mounted forcibly, so as to favor a possible easy removal of the spine 23 by simply overcoming the friction existing between the contacting surface portions. The pin 9 has no influence at all upon the axial arresting of the spine 23, but serves as a guide for the sliding and removal spine 23, through the hammer 10.

On the other hand, the action of the pusher 25 on the body 2 of the weapon, directed eccentrically with respect to the axis of the spine 23, generates a component force which tends to rotate the body 2 about the axis of the spine, thus establishing a constant contact without striking motions between the surfaces of the tongue 20 of the underguard 4 and the seat 22 provided at the base of the body 2. That is therefore the advantage of eliminating the inevitable play between the mating surfaces of the two coupled members.

The pusher 25 also serves the function of arresting the hammer 10 and defining the annular strike run of the hammer 10 when the body 2 and the handle 3 of the weapon are separated from each other. For this purpose the hammer 10 has a rear nose 10' which comes to rest against the pusher 25 as shown in FIG. 3 when the body 2 of the weapon is separated from the handle.

Figure 2:
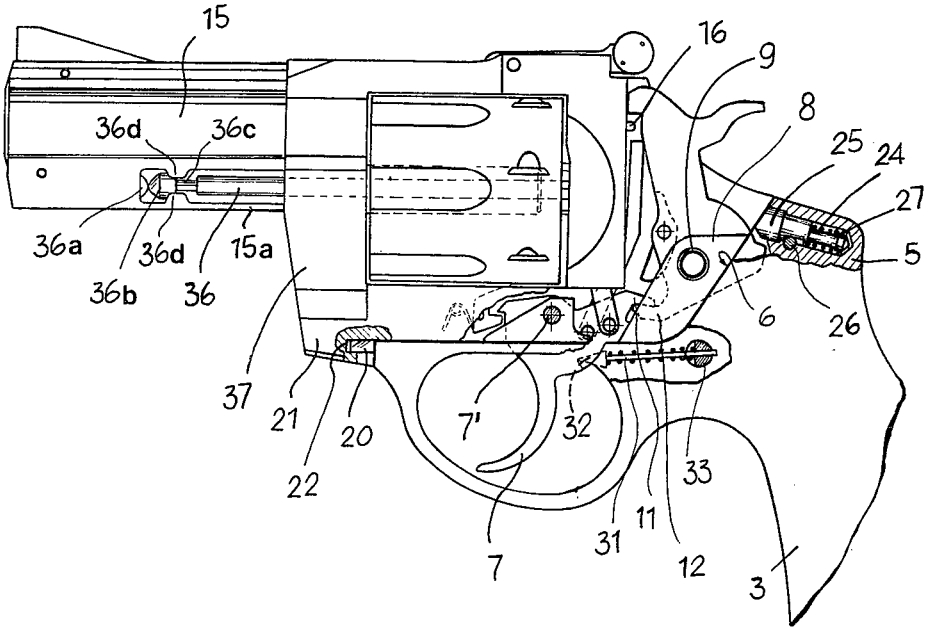
FIG. 2 is a side elevational view of the revolver in the assembled condition and with some portions sectionally illustrated.

The pusher 25 does not have any influence upon the hammer 10 during the utilization of the weapon. In fact, after the mounting of the body 2 and the forward displacement of the hammer 10, the pusher 25 is limited because it rests against a surface of the body 2, without the rear nose 10' resting against the spine 23 as shown in FIG. 2.

In accordance with another embodiment of the present invention, the trigger 7 is engaged by a pushing spring 30 which transmits a constant couple to the trigger 7 during the entire angular displacement thereof about its respective pin or pivot 7'. The spring 30 is mounted on a rod 31 (FIG. 2), one extremity of which engages a recess 32 provided on the trigger 7, while the opposite extremity of the rod 31 is connected to a transverse spine 33 that is rotatably inserted in the handle 3 as shown in FIG. 2. In this manner, the orientation of the rod 31 of the spring 30 with respect to the pin 7' varies with the displacement of the trigger 7. It follows that, the direction of push of the spring 30 is oriented eccentrically with respect to pin 7' of the trigger 7 and varies with the angular displacement of the trigger 7 about the pin 7' so that the couple which results is always substantially constant. The actuation of the trigger 7 is thus smoother and safer in that it is not necessary to increase the pulling action as the trigger 7 is displaced due to the disengagement of the hammer 10 at the time of firing.

A further feature of the present invention concerns the mounting of the rotating drum 17 on the body 2 of the weapon. The drum 17 is rotatably mounted, in a manner known per se, on its supporting shaft 35, within which extends a spring loaded rod 36 that is subjected to the action of a pusher **36*a* and which serves to block the drum itself in the position of use and to unblock it so as to displace it angularly and laterally from the body 2** of the weapon for the extraction and insertion of projectiles.

For such lateral, angular displacement the shaft 35 of the rotating drum 17 is formed as a single integral unit with a radial staff 37 and with a securing pin 38 that is oriented parallel to the shaft 35. The pin 38 defines the axis of rotation for the opening of the drum 17.

Figure 1:
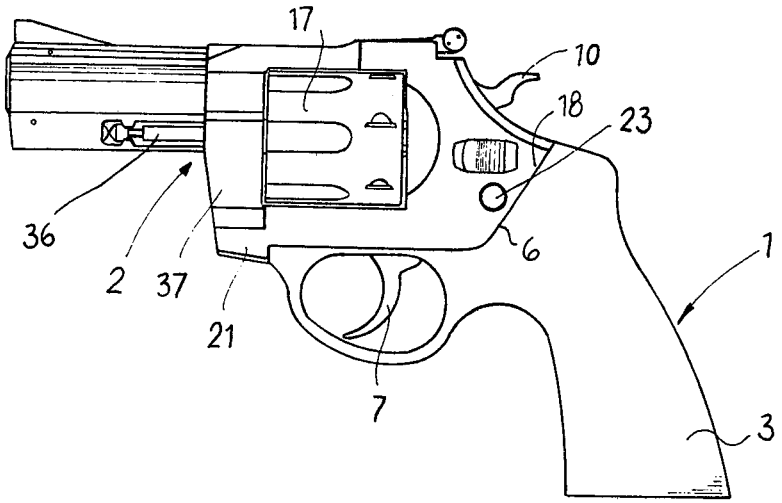
FIG. 1 is a side elevational view of the improved revolver comprising the present invention.
Figure 4:
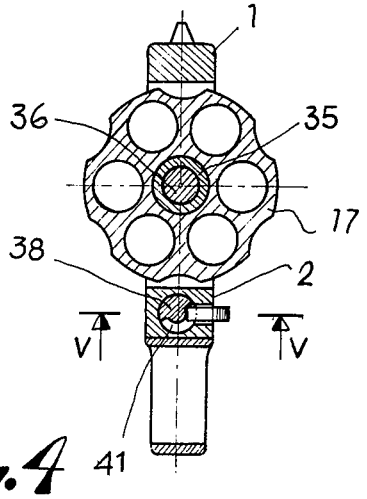
FIG. 4 is a transverse sectional elevational view taken through the rotatable drum shown in FIG. 1.
Figure 5:
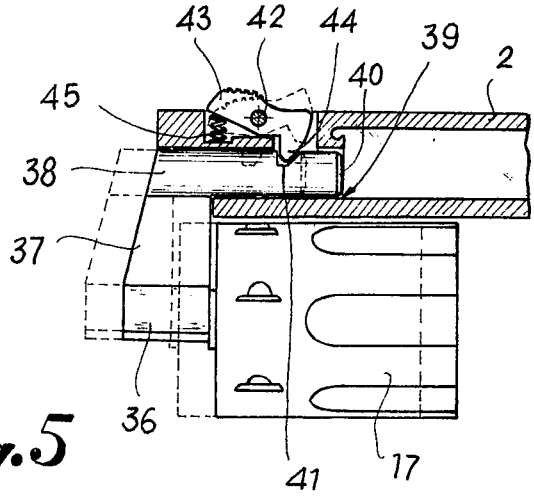
FIG. 5 is a longitudinal sectional view of the means for mounting and dismounting the rotatable drum taken along lines V—V in FIG. 4.

The pin 38 is inserted by sliding it rearwardly in a seat 39 provided for that purpose in the base of the body 2 of the weapon. The pin 38 has a beveled end 40 and is provided in its intermediate portion with a notch or throat 41 which has a substantially semicircular extension, as shown in FIG. 4.

On one side of the body 2 there is pivoted, by means of a pin 42, an arresting lever 43 that is manually displaceable which lever 43 has a projection 44 that faces the pin 38 and which serves to engage the notch 41 so as to block the pin 38 in an axial direction within the seat 39, while permitting the rotation of the drum 17. The lever 43 is actuated by a spring 45, which keeps it displaced so that its projection 44 normally engages in the notch 41 or, in any event, extends from the seat 39 when the pin has been removed.

The projection of the arresting lever 43 preferably has a cuneiform shape, the radius thereof, however, serving to interact with the pin 38 in an eccentric manner, with respect to the axis of rotation of the lever 43 while at least one side of the notch 41 has an inclined surface, which cooperates with the projection 33 so as to obtain a correct engagement of the notch 41. Because of the eccentricity of the radius of contact, permitting the recovery of or correction for the eventual axial play during the mounting operation of the pin 38 or the wearing caused by the repeated use of the weapon is possible.

In practice, the engagement of the rotatable drum 17 to the body 2 of the weapon is obtained without acting manually on the lever 43. It suffices to slide the pin 38 in its seat 39 so that the bevel of the extremity 40, in contact with the beveled projection 44 of the lever 43, determines the displacement of the lever 43 against the spring 45. The pin 38 can thus be slid freely within the seat 39 until the projection 44 of the lever 43 snap-wise engages the throat 41 of the pin 38 due to the action of the spring 45. At this point, the pin 38 is blocked axially by the projection 44 without possibility of a sliding action, unless one acts intentionally on the lever 43 by displacing it and disengaging the projection 44 from the notch 41.

The simplicity of mounting and dismounting of the rotatable drum 17 is thus evident. Such operation is possible without having to resort to the use of special tools or to specific arrangements.

It is further to be observed that the rod 36, which blocks the rotatable drum 17, has a head **36*b* defined by a collar 36*c* of reduced diameter; and that on the lower latch 15*a* of the barrel 15 there are provided two ears 36*d* which interact with the head 36*b* of the rod 36 to prevent eventual and uncontrolled lateral movement of the rod 36. This condition is assured by the pusher 36*a* which cooperates with the rod 36 to maintain the rod 36 in the unblocking position of the drum 17 on the body 2. To unblock the drum 17, the rod 36 is displaced toward and against the pusher 36*a*, so that the collar 36*c* comes in juxtaposition with the opening defined by or the space between the ears 36*d* so as to allow lateral movement of the rod 36 and, with it, rotatable drum 17**.

I claim:

1. A revolver of the type having an opening for the lateral displacement of a rotatable drum and comprising a body including first and second main members that are removably connected to each other, said first member comprising a handle and an underguard and a snap-firing mechanism defined by at least a trigger and a hammer, said second member comprising a stem, a barrel, sighting means, a firing pin and a rotatable drum with means for blocking and unblocking thereof, characterized in that at the extremity of said underguard of said first member there is provided a tongue for mortise-like engagement in a seat provided in a shoulder arranged at the base of said second member, an upper part of said handle and a rear terminal of said second member being provided with corresponding and mating inclined surfaces, said handle and said second member have coaxial transverse openings for the acceptance of an arresting spine for the mutual blocking of said first and second members, and means for eliminating play between said second member and said handle, said transverse openings for said arresting spine coinciding with an axis of rotation of said hammer, said axis being defined by a sleeve pin transversely mounted between two ears provided in the upper part of said handle, said openings provided in said second member being coaxial with said sleeve pin.

2. The revolver according to claim 1, wherein said trigger has a pivot pin and is actuated by a pushing spring which transmits to said trigger a couple that is contant throughout the angular displacement of said trigger, said spring being mounted on a rod having one extremity which engages a recess provided on said trigger and another opposed extremity connected to a further spine that is rotatably inserted within said handle, the direction of push of said spring being oriented eccentrically with respect to said pivot pin of said trigger and varying with the angular displacement of said trigger about said pivot pin.

3. The revolver according to claim 1, wherein said arresting spine is precision mounted in at least said openings of said second member.

4. The revolver according to claim 1, further comprising a rotating drum mounted on a supporting shaft within which a blocking spring rod extends to block said drum in a position of use and to block said drum for its opening, said shaft being formed integrally with a staff and with a securing pin extending parallel to said shaft, said securing pin being positioned for sliding from the front toward the rear in a further seat provided in said second member, characterized in that said securing pin has a beveled end and an intermediate notch which has a substantially semicircular extension, and a spring loaded arresting lever pivotally mounted on said second member having a projection facing said securing pin and snap-wise engaging said intermediate notch to axially block said securing pin and to prevent the sliding thereof from said further seat.

5. The revolver according to claim 4, wherein said projection of said arresting lever is cuneiformly shaped and eccentric with respect to the axis of rotation and in which at least one side of said notch in said securing pin is on an inclined plane, said projection and said inclined plane cooperating for the correction of coupling play.

6. The revolver according to claim 4, wherein said spring loaded rod has a head defined by a collar of reduced diameter, and wherein on a lower latch of said barrel there are provided two ears interacting with said head to prevent lateral displacements of said rod, when said rod is in blocking position of the drum on said second member, said ears defining therebetween a passage opening for said collar for said lateral displacement of said rod when said rod is in the unblocking position of said drum.

7. A revolver of the type having an opening for the lateral displacement of a rotatable drum and comprising a body including first and second main members that are removably connected to each other, said first member comprising a handle and an underguard and a snap-firing mechanism defined by at least a trigger and a hammer, said second member comprising a stem, a barrel, sighting means, a firing pin and a rotatable drum with means for blocking and unblocking thereof, characterized in that at the extremity of said underguard of said first member there is provided a tongue for mortise-like engagement in a seat provided in a shoulder arranged at the base of said second member, an upper part of said handle and a rear terminal of said second member being provided with corresponding and mating inclined surfaces, said handle and said second member have coaxial transverse openings for the acceptance of an arresting spine for the mutual blocking of said first and second members, and means for eliminating play between said second member and said handle, said inclined surface of said handle being defined by an upper portion of said handle protruding upwardly with respect to said underguard, and wherein on said upper portion of said handle there is mounted a spring-loaded pushing element facing toward the inclined surface of said upper portion so as to protrude therefrom and to engage against said inclined surface of said second member.

8. The revolver according to claim 7, wherein said spring loaded pusher includes a head surface having an inclination corresponding to that of said inclined surfaces of said handle and of said second member, the pushing direction of said spring-loaded pushing element being different from the perpendicular direction of said head surface.

9. The revolver according to claim 7, wherein said pushing element is defined by a means for limiting the forward run of said hammer when said second member is separated from said handle, said hammer having posteriorly, a nose arranged to rest against said pushing element.

10. A revolver comprising:

a first main member having a handle and underguard and firing means, said firing means including a pivotally mounted trigger and hammer;

a second main member connectable to said first main member for forming a revolver, said second member including a barrel, sighting means connected to said barrel for sighting along said barrel, a movable firing pin engageable by said hammer with said first and second main members connected and a rotatably mounted drum with means for blocking and unblocking said drum into and out of a use position on said second member;

a forward end of said underguard including a tongue and said second main member including a seat for receiving said tongue for engagement of said first and second main members together, said second member including a shoulder against which a forward end of said underguard is engageable;

an upper end of said handle including an inclined surface and a lower rearward end of said second main member including an inclined surface, said inclined surfaces mateable with each other with said first and second main members connected;

said handle and said second member having coaxial transverse openings therethrough with said first and second main members connected;

a spine extending through said coaxial transverse openings for securing said first and second main members together;

said handle including a pair of ears with openings therethrough coaxial with said coaxial transverse openings;

a sleeve pin extending through said coxial openings of said two ears for pivotally supporting said hammer, said spine extending coaxially through said sleeve pin;

means for eliminating play between said first and second members connected to at least one of said first and second members.

11. A revolver according to claim 10, wherein said means for eliminating play comprise a further seat defined in an upper portion of said handle having an open end communicating with said inclined surface of said handle, a pusher pin movably mounted in said further seat and biasing means connected in said further seat for biasing said pusher pin out beyond said inclined surface of said handle to engage said inclined surface of said second main member to bias said first and second main members apart at an upper end of said inclined surfaces thereof.

12. A revolver according to claim 11, wherein said pusher pin includes a reduced diameter portion in said seat around which said biasing means is disposed, said biasing means comprising a coil spring, said pusher pin including a notch and a securing pin connected to said handle and extending through said notch for retaining said pusher pin at least partially in said further seat.

13. A revolver according to claim 11, wherein said further seat has a longitudinal axis extending at a non-right angle to said inclined surfaces.

* * * * *